US005156090A

United States Patent [19]

Wirz

[11] Patent Number: 5,156,090

[45] Date of Patent: Oct. 20, 1992

[54] DEVICE FOR SMOOTHING A SHEET ON AN IMPRESSION CYLINDER OF A SHEET-FED ROTARY PRINTING MACHINE

[75] Inventor: Arno Wirz, Bammental, Fed. Rep. of Germany

[73] Assignee: Heidelberger Druckmaschinen AG, Heidelberg, Fed. Rep. of Germany

[21] Appl. No.: 805,118

[22] Filed: Dec. 10, 1991

Related U.S. Application Data

[63] Continuation-in-part of Ser. No. 542,425, Jun. 22, 1990, Pat. No. 5,086,698.

[30] Foreign Application Priority Data

Jun. 24, 1989 [DE] Fed. Rep. of Germany ..... 3920730
Dec. 10, 1990 [DE] Fed. Rep. of Germany ..... 4039311

[51] Int. Cl.[5] ..... B41F 9/00

[52] U.S. Cl. ..... 101/142; 101/230; 101/246; 271/195

[58] Field of Search ..... 101/142, 182, 230–232, 101/246, 409; 271/195, 276

[56] References Cited

U.S. PATENT DOCUMENTS

| | | | |
|---|---|---|---|
| 2,931,647 | 4/1960 | Para et al. | 101/230 |
| 3,986,455 | 10/1976 | Seschke et al. | 101/409 |
| 4,014,261 | 3/1977 | Becker | 101/230 |
| 4,122,773 | 10/1978 | Wirz | 101/230 |
| 4,127,265 | 11/1976 | Wirz et al. | 271/276 |
| 4,572,071 | 2/1986 | Cappel et al. | 101/183 |
| 4,579,446 | 4/1986 | Fujino et al. | 271/185 |
| 4,584,939 | 4/1986 | Giuri | 101/177 |
| 4,688,784 | 8/1987 | Wirz | 271/195 |
| 4,723,489 | 2/1988 | Emrich et al. | 101/230 |
| 4,796,529 | 1/1989 | Mathes | 101/230 |
| 4,869,166 | 9/1989 | Mathes | 101/230 |

FOREIGN PATENT DOCUMENTS 306684 3/1989 European Pat. Off. .

*Primary Examiner*—Eugene H. Eickholt
*Attorney, Agent, or Firm*—Herbert L. Lerner; Laurence A. Greenberg

[57] ABSTRACT

A device for smoothly applying a sheet for printing onto an impression cylinder upstream of a printing gap of a sheet-fed rotary offset printing machine in travel direction of the sheet through the printing machine and including a jet nozzle device having at least one jet nozzle capable of being directed towards the circumference of the impression cylinder for pressing the sheet by blowing air force against the circumference, further includes a drive device couplable with the jet nozzle device for swingingly reciprocating the jet nozzle device in travel direction of the sheet during an operating cycle of the printing machine, the jet nozzle device being mounted at a spaced distance upstream from a printing gap and being swingable in a pendular manner about a pendulum axis extending parallel to an axis of the impression cylinder, the jet nozszle device being elongated and being formed with a middle region and ends offset upstream from the middle region in the travel direction of the sheet so that the sheet is smoothed, beginning with the middle thereof, from the leading edge to the trailing edge of the sheet and simultaneously from the middle to the lateral sides of the sheet.

5 Claims, 5 Drawing Sheets

DEVICE FOR SMOOTHING A SHEET ON AN IMPRESSION CYLINDER OF A SHEET-FED ROTARY PRINTING MACHINE

CROSS-REFERENCE TO RELATED APPLICATION:

This application is a continuation-in-part of application Ser. No. 07/542,425, filed Jun. 22, 1990 now U.S. Pat. No. 5,086,698 and now allowed.

The invention relates to a device for smoothing printed sheets on an impression cylinder upstream of a printing gap of a sheet-fed rotary printing machine in travel direction of the sheet through the printing machine and including at least one jet nozzle capable of being directed towards the circumference of the impression cylinder for pressing the sheet by blowing-air force against the circumference.

European Patent 0 306 684 describes a device for smoothing sheets in a multicolor sheet-fed rotary printing machine which is positioned downstream from the printing gap above the impression cylinder of a printing unit and has jet fingers which are disposed so as to be fixed against torsion on a jet-finger tube at uniform spacing from one another over the width of the impression cylinder, the jet fingers having a lower region formed with air discharge openings and an air discharge surface matching the outer contour of the impression cylinder and extending to a tangential point between a downstream sheet-turning cylinder and the impression cylinder. The jet fingers, together with the finger tube, are mounted on fixed machine parts and, by means of an adjusting device, can be lifted up from the direction of the tangential point, during first form printing, and can be lowered in the direction of the tangential point, during perfector printing. This device is thus effective upstream of the printing gap, in order to apply the sheet printed in first form smoothly, through the action of blowing air, onto the closed surface of the impression cylinder in the region upstream of the tangential point between a sheet-turning cylinder and the impression cylinder upstream therefrom, until the end of the sheet is gripped by the sheet-turning cylinder. According to this publication, however, axially parallel jet strips disposed upstream of the printing zone above air impression cylinder, so that the sheet is smoothly applied to the surface of the impression cylinder by means of blown air, are in the state of the art.

A device with a jet tube and nozzles thereon, which are adjustable in the direction of the jet, to blow a sheet which is to be printed against a feeder drum in a multicolor sheet-fed rotary printing machine has become known heretofore from German Published Non-Prosecuted Application (DE-OS) 25 50 721. This device, however, is not intended to apply the sheet to be printed smoothly at the circumference of the impression cylinder.

The control of blown air for devices according to the state of the art has become known heretofore from German Published Non-Prosecuted Application (DE-OS) 36 35 089. Finally, German Patent 1 061 798 describes smoothing brushes arranged upstream of the printing gap and acting towards the circumference of the impression cylinder, the smoothing brushes being lifted when the leading edge of the sheet passes, and applying the sheet smoothly against the impression cylinder after the leading edge of the sheet has travelled past.

It is accordingly an object of the invention to provide a device for smoothing a sheet at the circumference of the impression cylinder upstream of the printing gap of a sheet-fed rotary printing machine which is improved so that a reliable, close-fitting application of the sheet to be printed on the impression cylinder is effected regardless of the type of paper of the sheet to be printed, before the latter enters the printing gap, as well as so that there is a greater certainty that a print will be produced without doubling or smearing, even at very high printing speeds.

With the foregoing and other objects in view, there is provided, in accordance with the invention, a device for smoothly applying a sheet for printing onto an impression cylinder upstream of a printing gap of a sheet-fed rotary offset printing machine in travel direction of the sheet through the printing machine and including a jet nozzle device having at least one jet nozzle capable of being directed towards the circumference of the impression cylinder for pressing the sheet by blowing air force against the circumference, comprising drive means couplable with the jet nozzle device for swingingly reciprocating the jet nozzle device in travel direction of the sheet during an operating cycle of the printing machine, the jet nozzle device being mounted at a spaced distance upstream from a printing gap and being swingable in a pendular manner about a pendulum axis extending parallel to an axis of the impression cylinder, the jet nozzle device being elongated and being formed with a middle region and ends offset upstream from the middle region in the travel direction of the sheet so that the sheet is smoothed beginning with the middle thereof from the leading edge to the traveling edge of the sheet and simultaneously from the middle to the lateral side of the sheet.

These structural features increase the possibilities for contactless action upon the sheet to be printed, for the purpose of achieving a reliable and close-fitting application on the impression cylinder before the sheet to be printed enters the printing gap, and improve the possibilities of exerting any influence as compared with heretofore-known devices.

In accordance with another feature of the invention, the jet nozzle device has a sword nozzle having a means defining at least one nozzle opening, the means being formed with a bend.

In accordance with a further feature of the invention, the means defining the nozzle opening extends across a major part of the width of the impression cylinder.

In accordance with an added feature of the invention, the means defining the nozzle opening is formed as an arrowhead having a point facing opposite to the direction of travel of the sheet.

A lever drive with a cam control, for example, is suitable for the drive of the swinging pendulum movement of the sword nozzle in the working cycle of the machine.

If necessary or desirable, several swingingly moved smoothing nozzles having the hereinafore-described structural features can be positioned one behind the other in circumferential direction of the impression cylinder. It is also possible to arrange a swinging smoothing nozzle downstream of or upstream of the printing gap, in connection with a jet nozzle which is adjustable in the direction of the air jet, if necessary or desirable, but which is fixed in position during operation.

In accordance with an additional feature of the invention, the elongated jet nozzle device is formed of a plurality of jet nozzles disposed at locations between the ends of the jet nozzle device.

In accordance with a concomitant feature of the invention, the plurality of jet nozzles are individually controllable.

Other features which are considered as characteristic for the invention are set forth in the appended claims.

Although the invention is illustrated and described herein as embodied in a device for smoothing a sheet on an impression cylinder of a sheet-fed rotary printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 2:
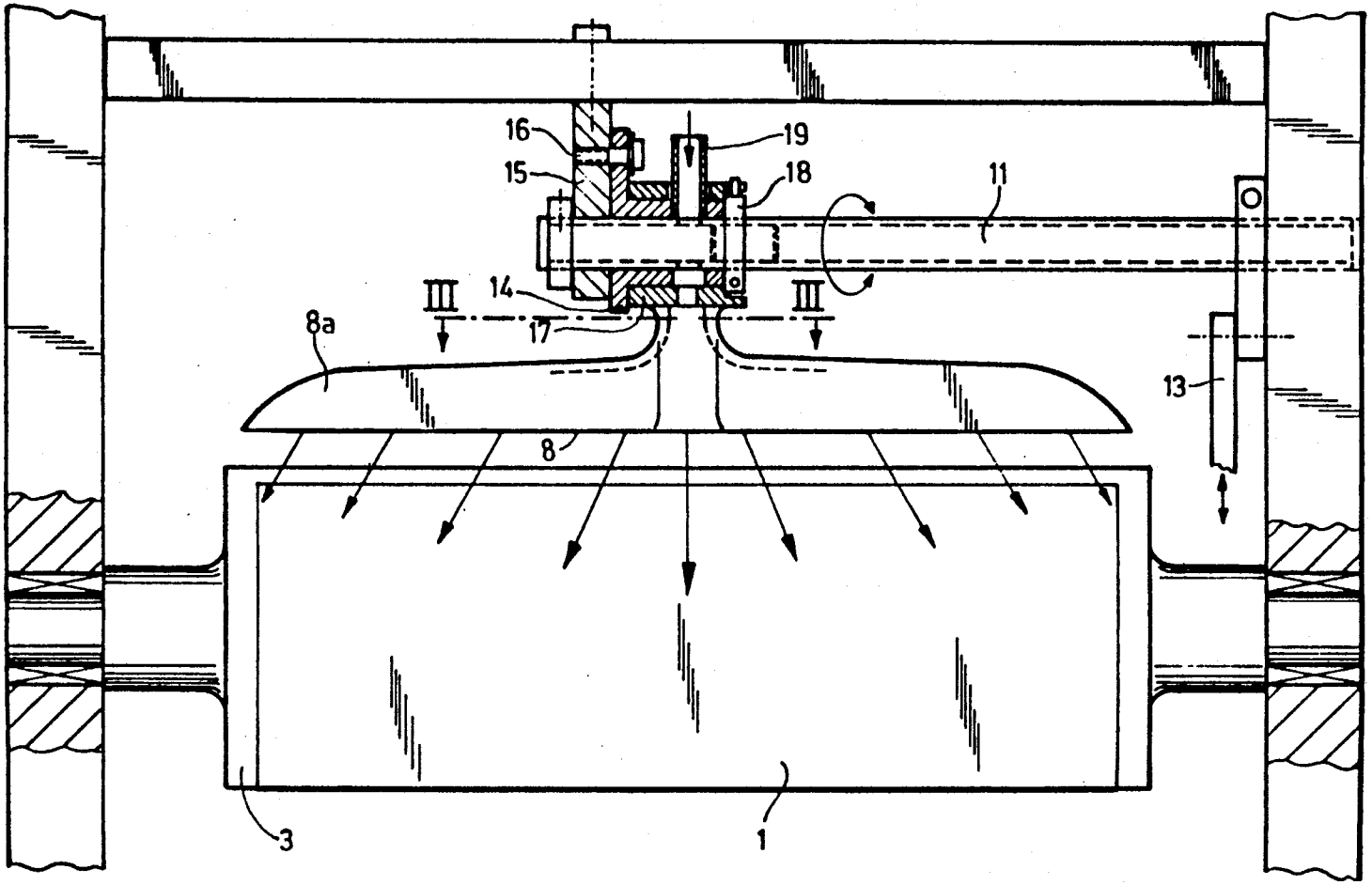
FIG. 2 is an elevational view, partly in section, of a smoothing nozzle device disposed across the direction of print sheet, the view being much enlarged with respect to that of FIG. 1.
Figure 3:
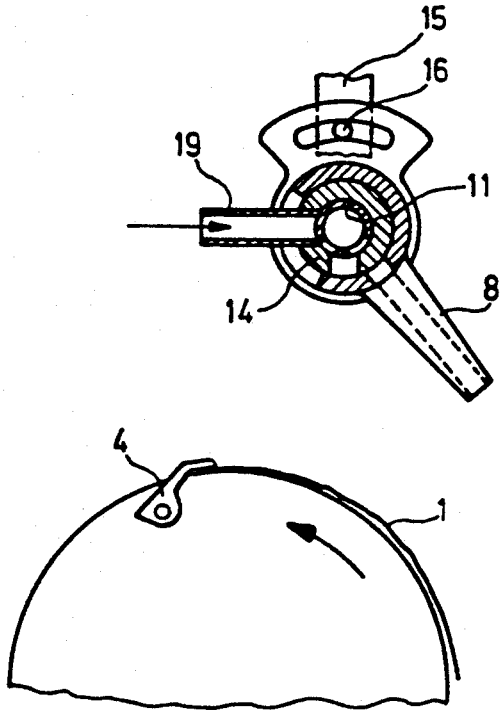
FIGS. 3 and 4 are respective cross-sectional views of FIG. 2 in two different adjustable end positions thereof.
Figure 4:
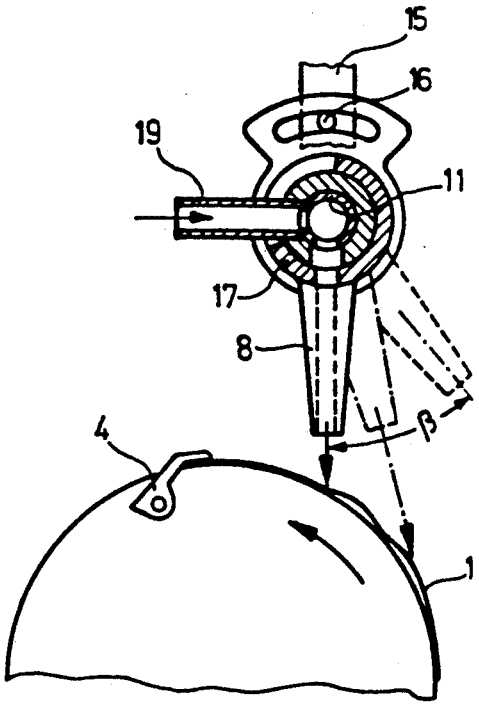
Figure 5:
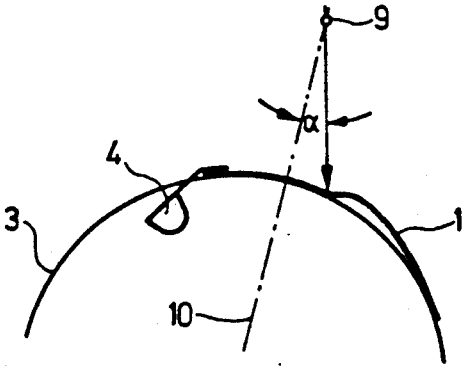
Figure 6:
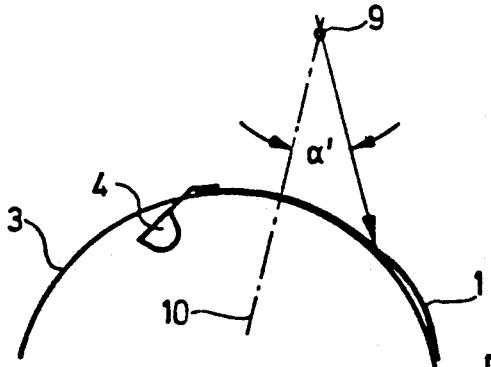
Figure 7:
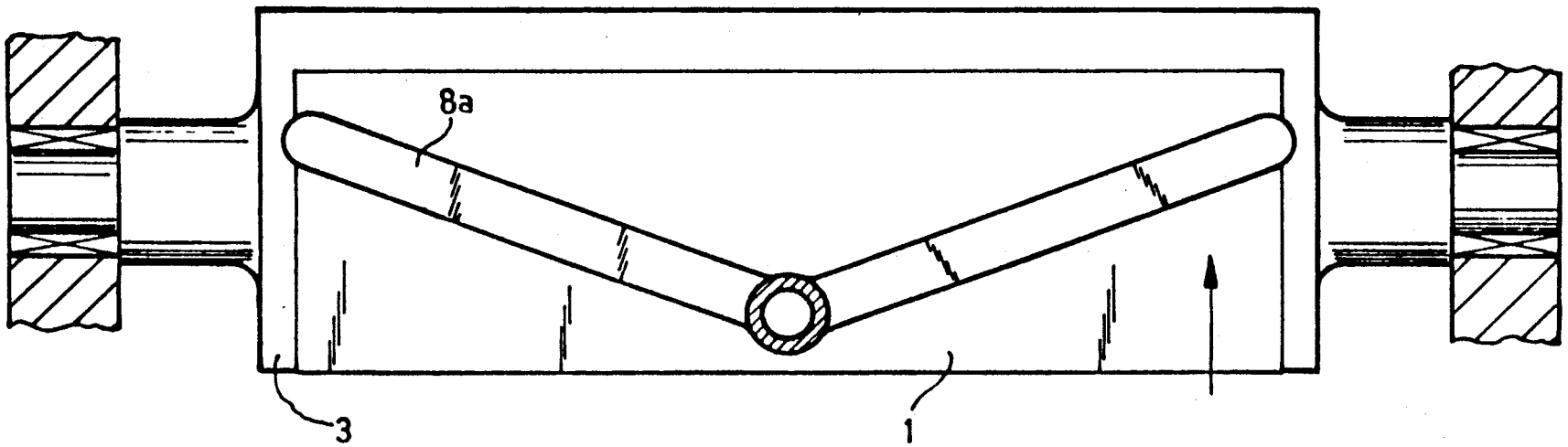
Figure 8:
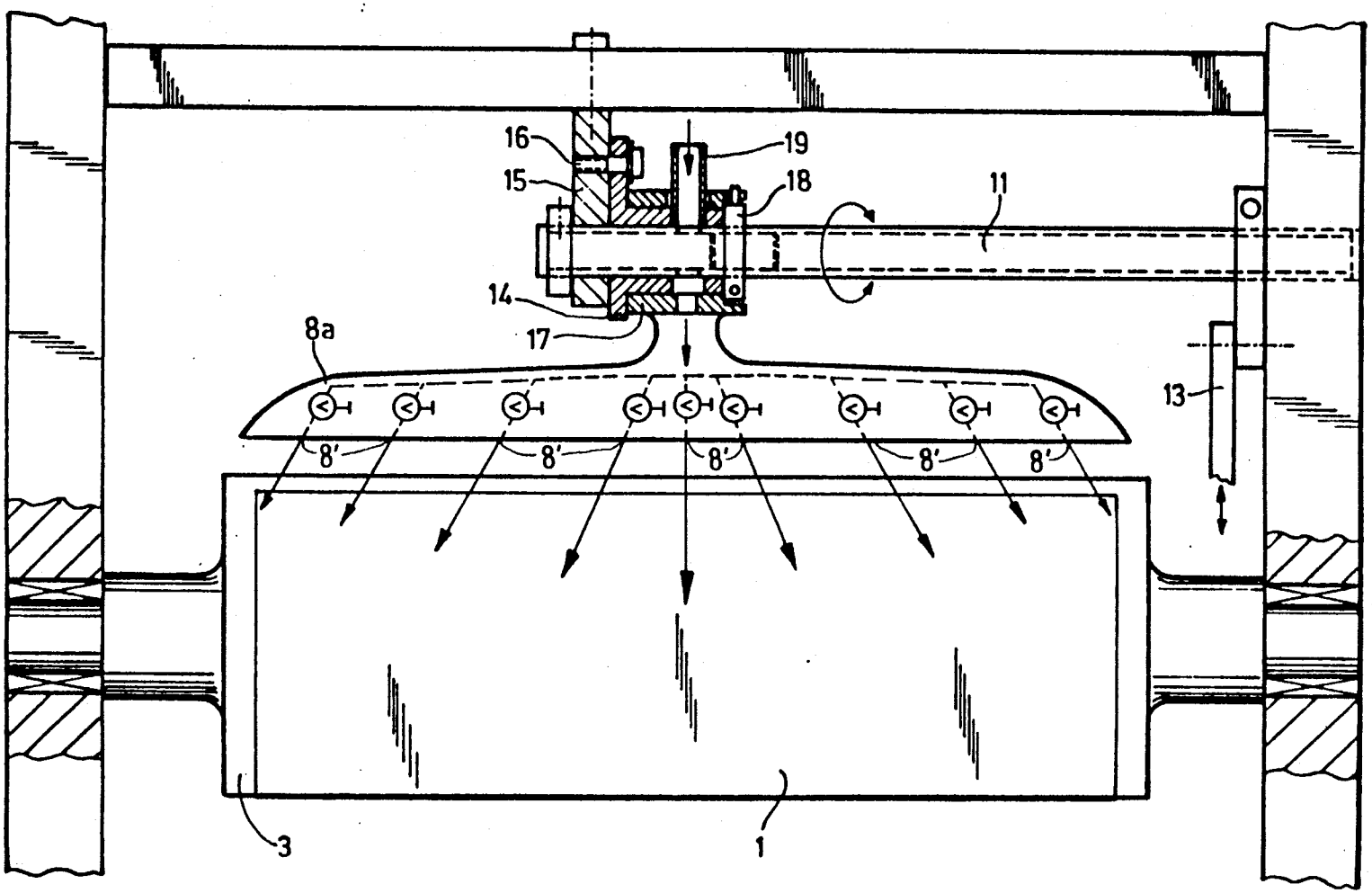

FIGS. 5 and 6 ar diagrammatic views similar to parts of FIGS. 3 and 4 and depicting different setting angles for the application of an air jet which depend upon the quality of the paper to be printed;

FIG. 7 is a view of FIG. 2 taken along the line VII—VII in the direction of the arrows and showing another embodiment of the invention; and FIG. 8 is a view like that of FIG. 2 of a further embodiment of the invention, shown partly schematically.

Figure 1:
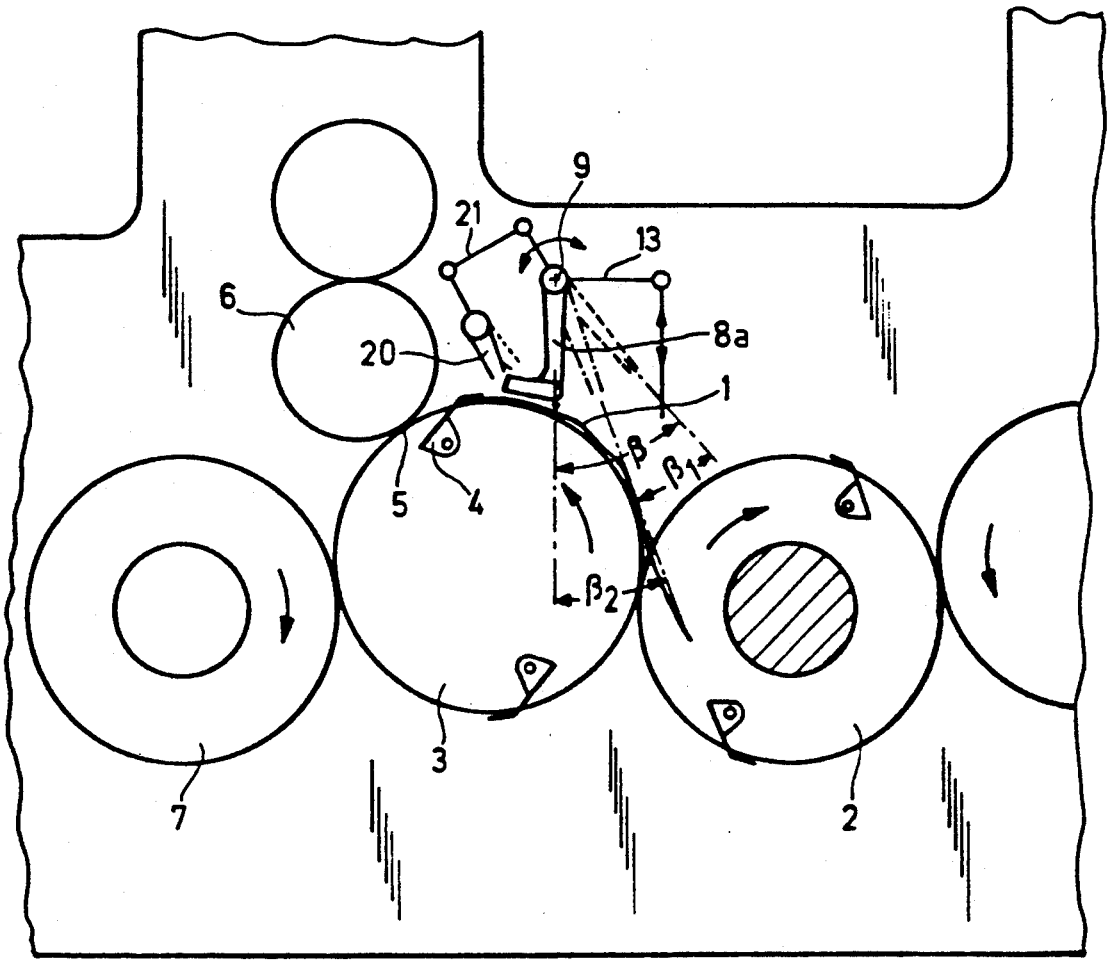
FIG. 1 is a diagrammatic side elevational view of a printing unit incorporating a device for smoothing a sheet on an impression cylinder thereof, in accordance with the invention.

Referring now to the drawing and, first, particularly to FIG. 1 thereof, there is shown diagrammatically therein a side elevational view of a printing unit of a multi-color sheet-fed rotary printing machine. A printed sheet 1, accepted from a printing unit located upstream thereto in the travel direction of the sheet, is transferred by a transfer drum 2 to an impression cylinder 3 of a printing unit downstream therefrom. Sheet grippers 4 grip the printed sheet 1 at a tangential point between the transfer drum 2 and the impression cylinder 3 and draw the printed sheet 1 through a printing nip or gap 5 between the impression cylinder 3 and a rubber blanket cylinder 6. Downstream from the printing gap 5, the printed sheet 1 is fed to another transfer drum 7, which surrenders the printed sheet 1 to another printing unit.

In order to achieve a secure and close-fitting application of the printed sheet 1 to the circumference of the impression cylinder 3, a jet or blowing nozzle 8 of a jet nozzle device 8*a* is directed towards the circumference of the impression cylinder 3 at a given spaced distance from in front or upstream of the printing gap 5. The nozzle 8 is mounted so as to be swingable about a pendulum axis 9, and is couplable to a drive which reciprocates the jet nozzle 8 swingingly in the direction of travel of the sheet during the operation cycle of the printing machine. It is particularly advantageous for the jet nozzle 8 to be constructed as a sword-type nozzle corresponding to the representation thereof in FIG. 2, the nozzle opening of which extends at least over a considerable part of the width of the impression cylinder 3, and preferably over the entire width thereof. The angular range for the swinging movement of the jet nozzle 8 is adjustable and in fact, so that both a setting angle $\alpha$ and $\alpha'$, respectively (FIGS. 5 and 6) of the jet direction with regard to the normal 10 through the pendulum axis 9 on the circumference of the impression cylinder 3, as well as a swivel angle $\beta$ (FIGS. 1 and 4) are adjustable.

In the illustrated embodiment, the jet nozzle 8 is fastened to a tube 11 so as to be adjustable in the direction of the circumference thereof, the tube 11 being mounted in the frame 12 of the machine so that it can be swung pendulously about the longitudinal axis thereof. A lever train or transmission 13 with a cam control or the like is suitable for the drive of the swinging or pendular movement of the jet nozzle 8, and is provided in the case of the illustrated embodiment. By means of a tube-shaped housing 17, the jet nozzle 8 is slipped onto a casing of a valve adjusting ring 14, which is adjustable with respect to a frame part 15 by means of a screw 16. The valve adjusting ring 14 is guided laterally by an entrainer 18 (FIG. 2). A radially directed connection 19 for an air conduit (which is not shown in the drawing) extends into the housing 17 and is fastened at its inner end to the valve adjusting ring 14. For purposes of adjustment, this connection is movable radially in a range corresponding to the range of the angle of adjustment. After loosening the screw 16 and the entrainer 18, an adjustment can be performed for changing the setting or adjustment angle $\alpha$ with respect to the normals 10. The swivel angle $\beta$ is adjusted by the lever train or transmission 13 in the selected embodiment of the invention. The air control for the jet nozzle 8 is achieved by covering radial openings in the tube 11 with the inner end of the connection 19 and a passage in the housing 17 to the jet nozzle 8, respectively.

In the smallest adjustment angle $\alpha$, the air jet from the jet nozzle 8 is directable almost perpendicularly or vertically onto the surface of the impression cylinder 3. The center of the pendulous movements of the jet nozzle 8 lies somewhat on a tangent to the impression cylinder 3 passing through the pendulum axis 9, so that the jet nozzle 8 moves in a swinging manner out of a swing-back zero position without air feed, as is represented in FIG. 3 by solid lines, and in FIG. 4 by broken lines, to a forward position, which is represented in FIG. 4 by solid lines. This offers the advantage that, in particular, when cardboard sheets are processed in machines with diverting or looping drums without shell plates or sheetmetal casings, an air jet can be directed, in the swivel angle region $\beta_1$, onto the trailing end of the sheet, in order to force the latter away from the shaft of the diverting drum 2, and thereby preventing blotting phenomena. In the forward swivel angle region $\beta_2$, the air from the jet nozzle 8 forces the sheet against the circumference of the impression cylinder 3. The swivelling movement of the jet nozzle 8 thus takes place advantageously opposite to the direction of travel of the sheet 1 on the circumference of the impression cylinder 3.

To avoid underblowing the printed sheet, the air jet from the jet nozzle 8 can be interrupted when the leading edge of the printed sheet 1 travels by, or the jet nozzle device 8*a* may be in a swivelling position which prevents underblowing of the printed sheet at its leading edge as the sheet travels by.

The jet nozzle 8 is preferably able to be fixed, or is decouplable from the drive, in the swivelled-back final position thereof; as is represented, for example, by broken lines in FIG. 4, in order to permit switching off if the jet nozzle 8 is not required for printing processes.

Instead of the hereinafore-described control of the air feed to the jet nozzle 8 by means of the pendular movement of the jet nozzle device 8*a*, other conventional devices can be used.

In FIG. 1, a diagrammatically illustrated possibility for positioning another pendulum nozzle 20 is presented, which can be coupled to the tube 11 or the lever train or transmission 13 by means of another lever train or transmission 21. In this way, the swing angle of the nozzle 20 can deviate from the swing angle of the nozzle 8 and, likewise, the adjusted setting angle can be different. Instead of a pendulum nozzle 20, a nozzle which can be adjusted but which is nevertheless fixed during operation can also be provided.

The embodiment of FIG. 7 includes a sword-type nozzle 8 which is not rectilinear from end to end but is rather arrowhead-shaped with the point thereof facing opposite to the direction of travel of the sheet 1 i.e. facing in the direction from which the sheet is coming. In this regard, it is noted that, instead of being formed as an arrow head, the sword-type nozzle 8 may have an arcuate shape or other shape, just so long as the sheet to be printed, before it is introduced into the printing nip or gap 5 between the impression cylinder 3 and the blanket cylinder 6, is subjected therefrom with blowing air initially in the middle of the sheet and extending from the leading edge of the sheet 1 towards the trailing edge of the sheet 1 so as to smooth the sheet 1 from its leading edge to its trailing edge and, simultaneously, from the middle thereof towards the lateral sides thereof. By this action, a contract-free application of force is achieved which causes a reliable and complete laying of the sheet on the impression cylinder 3.

In FIG. 8, a further embodiment of the invention is illustrated partly schematically. Instead of having a single wide-mouthed nozzle 8, the jet nozzle device 8*a* according to the invention is formed with several nozzles 8', shown diagrammatically, which are disposed at various locations between the ends of the nozzle device 8*a*. Each of the nozzles 8' is individually controllable by a suitable throttle valve V connected in an air supply line coming from the connection 19 to the non-illustrated air conduit. The throttle valves V may be manually operated directly or electrically by remote control in a conventional manner.

I claim:

1. Device for smoothly applying a sheet for printing onto an impression cylinder upstream of a printing gap of a sheet-fed rotary offset printing machine in travel direction of the sheet through the printing machine the device including a jet nozzle device having at least one jet nozzle capable of being directed towards the circumference of the impression cylinder for pressing the sheet by blowing air force against the circumference, comprising drive means couplable with the jet nozzle device for swingingly reciprocating the jet nozzle device in travel direction of the sheet during an operating cycle of the printing machine, the jet nozzle device being mounted at a spaced distance upstream from a printing gap and being swingable in a pendular manner about a pendulum axis extending parallel to an axis of the impression cylinder, the jet nozzle device being elongated and being formed with a middle region and ends offset upstream from the middle region in the travel direction of the sheet so that the sheet is smoothed, beginning with the middle thereof, from the leading edge to the trailing edge of the sheet and simultaneously from the middle to the lateral sides of the sheet.

2. Sheet-applying device according to claim 1, wherein the jet nozzle device has a sword nozzle having means defining at least one nozzle opening, said last-mentioned means being formed with a bend.

3. Sheet-applying device according to claim 2, wherein said means defining said nozzle opening is formed as an arrowhead having a point facing opposite to the direction of travel of the sheet.

4. Sheet-applying device according to claim 1, wherein the elongated jet nozzle device is formed of a plurality of jet nozzles disposed at locations between said ends of the jet nozzle device.

5. Sheet-applying device according to claim 4, wherein said plurality of jet nozzle are individually controllable.

* * * * *